US007870850B2

(12) United States Patent
Herman et al.

(10) Patent No.: US 7,870,850 B2
(45) **Date of Patent: *Jan. 18, 2011**

(54) CRANKCASE VENTILATION SYSTEM WITH PUMPED SCAVENGED OIL

(75) Inventors: Peter K. Herman, Stoughton, WI (US); Michael J. Connor, Stoughton, WI (US); Christopher E. Holm, Madison, WI (US); Mark V. Holzmann, Stoughton, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/728,301

(22) Filed: Mar. 22, 2010

(65) Prior Publication Data

US 2010/0175642 A1 Jul. 15, 2010

Related U.S. Application Data

(62) Division of application No. 11/828,613, filed on Jul. 26, 2007, now Pat. No. 7,699,029.

(51) Int. Cl.
*F01M 13/04* (2006.01)

(52) U.S. Cl. ..... 123/572

(58) Field of Classification Search ..... 123/572–574, 123/41.86; 55/309
See application file for complete search history.

(56) References Cited

U.S. PATENT DOCUMENTS

| | | | | |
|---|---|---|---|---|
| 3,824,973 | A | 7/1974 | Harhaus | |
| 4,269,607 | A | 5/1981 | Walker | |
| 4,557,226 | A | 12/1985 | Mayer et al. | |
| 5,487,371 | A | 1/1996 | Beckman et al. | |
| 5,579,744 | A | 12/1996 | Trefz | |
| 5,803,025 | A | 9/1998 | Feucht | |
| 6,247,463 | B1 | 6/2001 | Fedorowicz et al. | |
| 6,279,555 | B1 | 8/2001 | Crowell et al. | |
| 6,279,556 | B1 | 8/2001 | Busen et al. | |
| 6,290,738 | B1 | 9/2001 | Holm | |
| 6,354,283 | B1 | 3/2002 | Hawkins et al. | |
| 6,422,224 | B1 * | 7/2002 | Walker, Jr. | 123/572 |
| 6,478,019 | B2 | 11/2002 | Fedorowicz et al. | |
| 6,505,615 | B2 | 1/2003 | Pietschner | |
| 6,520,164 | B1 | 2/2003 | Lepp et al. | |
| 6,626,163 | B1 | 9/2003 | Busen et al. | |

(Continued)

FOREIGN PATENT DOCUMENTS

| | | |
|---|---|---|
| EP | 1275828 | 1/2003 |

OTHER PUBLICATIONS

"The Design of Jet Pumps", Gustav Flugel, National Advisory Committee for Aeronautics, Technical Memorandum No. 982, 1939.

(Continued)

*Primary Examiner*—M. McMahon
(74) *Attorney, Agent, or Firm*—Andrus, Sceales, Starke & Sawall, LLP; J. Bruce Schelkopf

(57) ABSTRACT

A crankcase ventilation system for an internal combustion engine has a jet pump suctioning scavenged separated oil from the oil outlet of an air/oil separator and pumping same to the crankcase.

21 Claims, 7 Drawing Sheets

U.S. PATENT DOCUMENTS

| | | | | |
|---|---|---|---|---|
| 6,684,864 | B1 | 2/2004 | Busen et al. | |
| 7,238,216 | B2 | 7/2007 | Malgorn et al. | |
| 7,281,532 | B2 | 10/2007 | Kakimoto et al. | |
| 7,473,291 | B2 | 1/2009 | Evenstad et al. | |
| 7,699,029 | B2 * | 4/2010 | Herman et al. | 123/41.86 |
| 2002/0078936 | A1 * | 6/2002 | Shureb | 123/572 |
| 2002/0088445 | A1 * | 7/2002 | Weindorf et al. | 123/572 |
| 2003/0101960 | A1 | 6/2003 | Tuschiya et al. | |
| 2004/0069287 | A1 * | 4/2004 | Matsuda et al. | 123/573 |
| 2006/0062699 | A1 | 3/2006 | Evenstad et al. | |
| 2006/0086649 | A1 | 4/2006 | Wieczorek | |
| 2006/0124117 | A1 | 6/2006 | Knauf et al. | |
| 2007/0256566 | A1 | 11/2007 | Faber et al. | |

OTHER PUBLICATIONS

"Jet-Pump Theory and Performance with Fluids of High Viscosity", R.G. Cunningham, Transactions of the ASME, Nov. 1957, pp. 1807-1820.

* cited by examiner

CRANKCASE VENTILATION SYSTEM WITH PUMPED SCAVENGED OIL

CROSS REFERENCE TO RELATED APPLICATION

This application is a division of U.S. patent application Ser. No. 11/828, 613, filed Jul. 26, 2007.

BACKGROUND AND SUMMARY

The invention relates to crankcase ventilation systems for internal combustion engines.

Crankcase ventilation systems for internal combustion engines are known in the prior art. An internal combustion engine generates blowby gas in a crankcase containing engine oil and oil aerosol. An air/oil separator has an inlet receiving blowby gas and oil aerosol from the crankcase, and an air outlet discharging clean blowby gas to the atmosphere or back to the engine air intake, and an oil outlet discharging scavenged separated oil back to the crankcase. The separator has a pressure drop thereacross such that the pressure at its inlet and in the crankcase is higher than the pressure at the separator air outlet and oil outlet. The pressure differential between the crankcase and the oil outlet of the separator normally tends to cause backflow of oil from the higher pressure crankcase to the lower pressure oil outlet. It is known in the prior art to locate the oil outlet of the separator at a given vertical elevation above the crankcase and to provide a vertical connection tube therebetween with a check valve to in turn provide a gravity head overcoming the noted pressure differential and backflow tendency, in order that oil can drain from the separator to the crankcase.

The present invention provides another solution to the above noted problem in a simple and effective manner.

DETAILED DESCRIPTION

Figure 1:
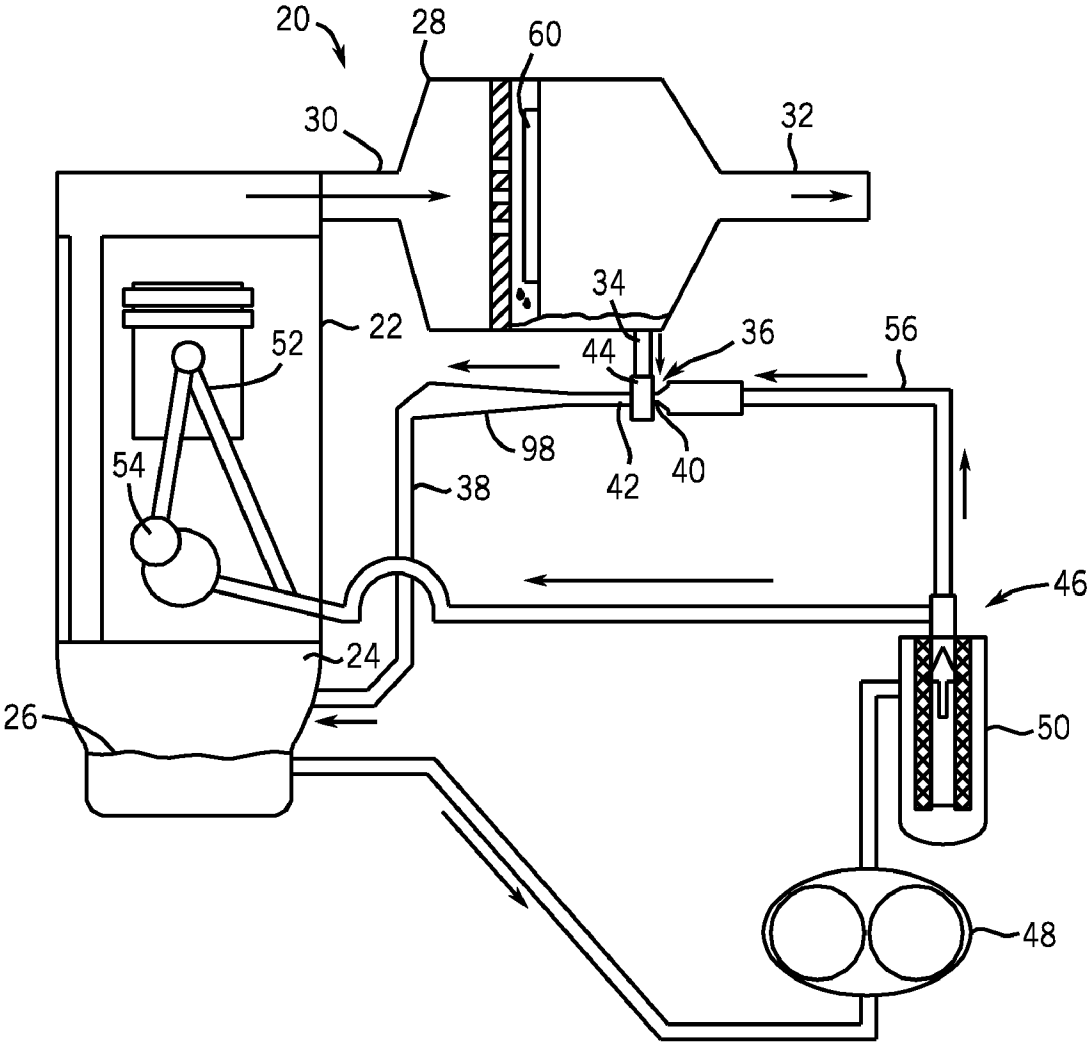
FIG. 1 is a schematic illustration of a crankcase ventilation system for an internal combustion engine in accordance with the invention.
Figure 2:
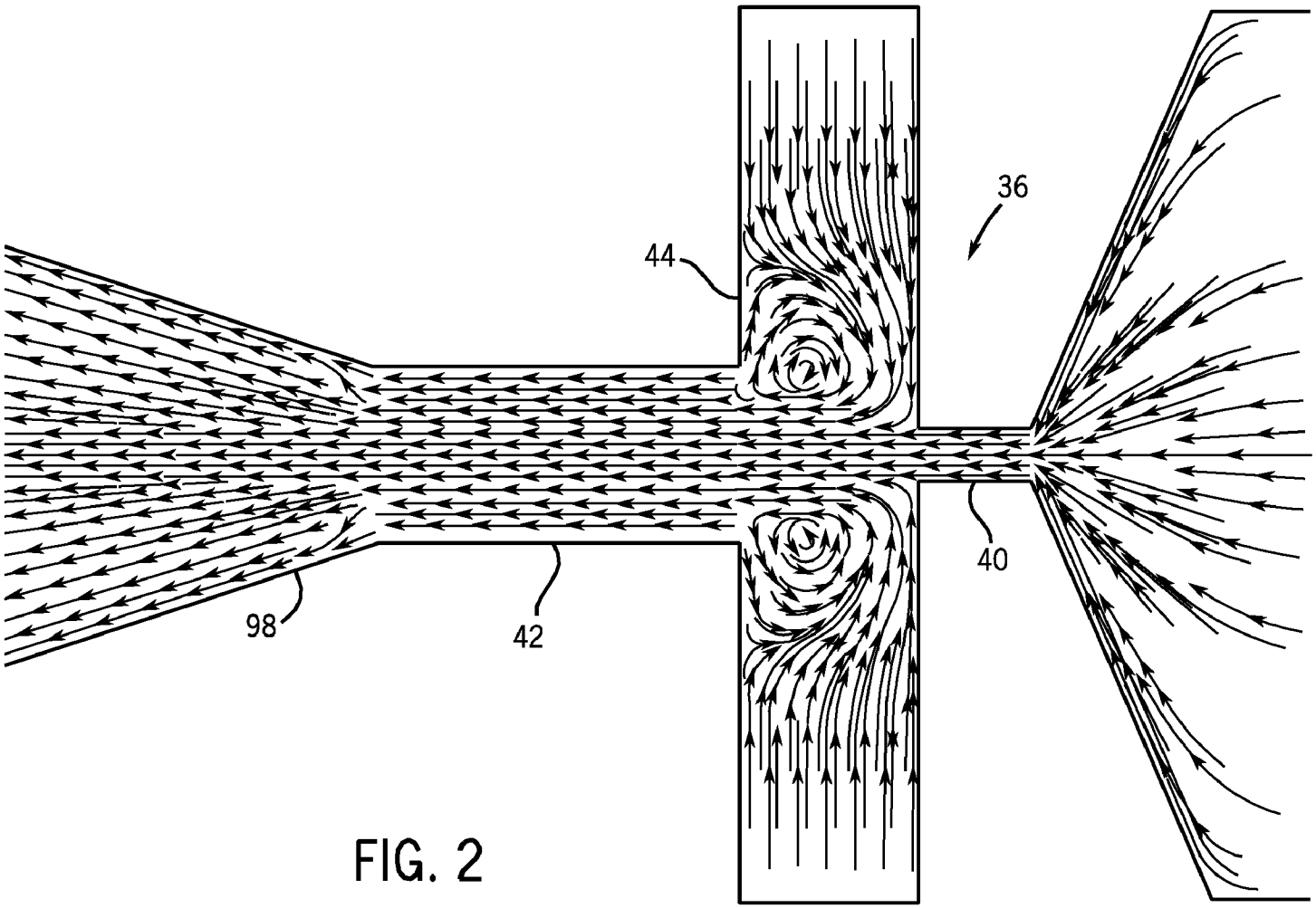
FIG. 2 is fluid flow diagram illustrating operation of a component of FIG. 1.

FIG. 1 shows a crankcase ventilation system 20 for an internal combustion engine 22 generating blowby gas in a crankcase 24 containing engine oil 26 and oil aerosol. The system includes an air/oil separator 28 having an inlet 30 receiving blowby gas and oil aerosol from the crankcase, and having an air outlet 32 discharging clean blowby gas to the atmosphere or returned to the engine air intake, and having an oil outlet 34 discharging scavenged separated oil back to the crankcase, all as is known. In one embodiment air/oil separator 28 is an inertial impactor, for example as in the following incorporated U.S. Pat. Nos. 6,247,463; 6,290,738; 6,354,283; 6,478,109. The system further includes a jet pump 36 pumping scavenged separated oil from oil outlet 34 to crankcase 24. Jet pumps are known in the prior art, for example: "The Design of Jet Pumps", Gustav Flugel, National Advisory Committee for Aeronautics, Technical Memorandum No. 982, 1939; "Jet-Pump Theory and Performance with Fluids of High Viscosity", R. G. Cunningham, Transactions of the ASME, November 1957, pages 1807-1820. Separator 28 has a pressure drop thereacross such that the pressure at inlet 30 and in crankcase 24 is higher than the pressure at air outlet 32 and at oil outlet 34. The pressure differential between crankcase 24 and oil outlet 34 normally tends to cause backflow of oil from the higher pressure crankcase 24 to the lower pressure oil outlet 34. In the prior art, oil outlet 34 is located at a given elevation above crankcase 24 (typically greater than about 15 inches, though the dimensions vary) and a vertical connection tube is provided therebetween with a check valve, such that a gravity head develops and can overcome the noted pressure differential. In contrast, jet pump 36 in the present system supplies pumping pressure greater than the noted pressure differential to overcome the noted backflow tendency and instead cause suctioning of scavenged separated oil from oil outlet 34 and pumping of same to crankcase 24 via connection conduit 38. As is known, a jet pump is operated by a motive fluid directed through a reduced diameter jet nozzle 40 into a larger diametered mixing bore 42 having a suction chamber 44 therearound. The momentum exchange between the high velocity motive jet flow from motive jet nozzle 40 and the lower velocity surrounding fluid in mixing bore 42 creates the pumping effect which suctions and pumps fluid from chamber 44, for example as shown in the flow diagram in FIG. 2. In FIG. 1, jet pump 36 is a fluid-driven jet pump having a pressurized drive input at 40 receiving pressurized motive fluid from a source of pressurized fluid, a suction input at 44 receiving separated oil from oil outlet 34 of separator 28, and an output at 42 delivering jet-pumped oil to crankcase 24 via conduit 38.

The engine includes an oil circulation system 46 circulating engine oil 26 from crankcase 24 through an oil pump 48 delivering pressurized oil through filter 50 to selected engine components such as piston 52 and crankshaft 54 and then back to crankcase 24. In the embodiment of FIG. 1, jet pump 36 is an oil-driven jet pump having a pressurized drive input via conduit 56 receiving pressurized motive oil from oil pump 48, a suction input at 44 receiving separated oil from oil outlet 34 of separator 28, and an output at 42 delivering jet-pumped oil via conduit 38 to crankcase 24.

Figure 3:
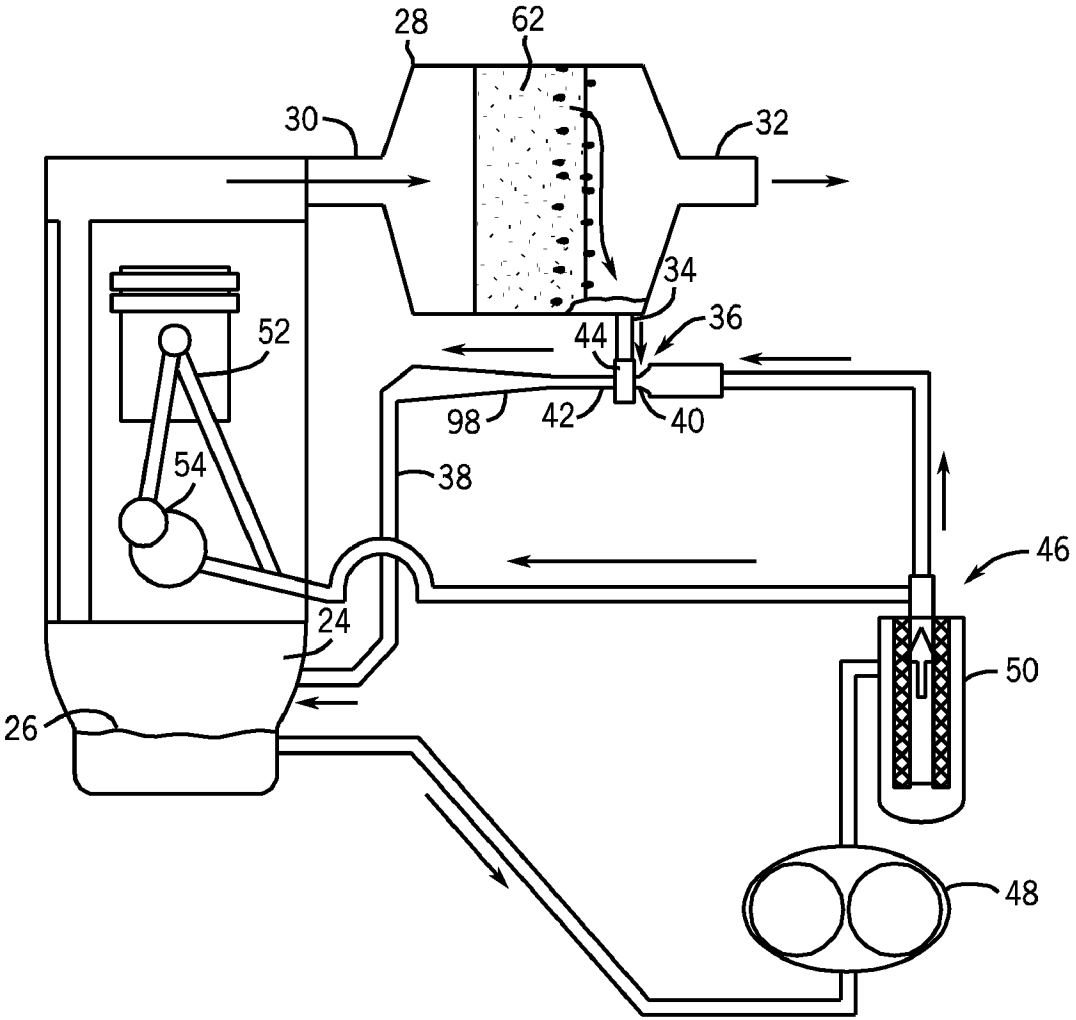
FIG. 3 is like FIG. 1 and shows another embodiment.
Figure 4:
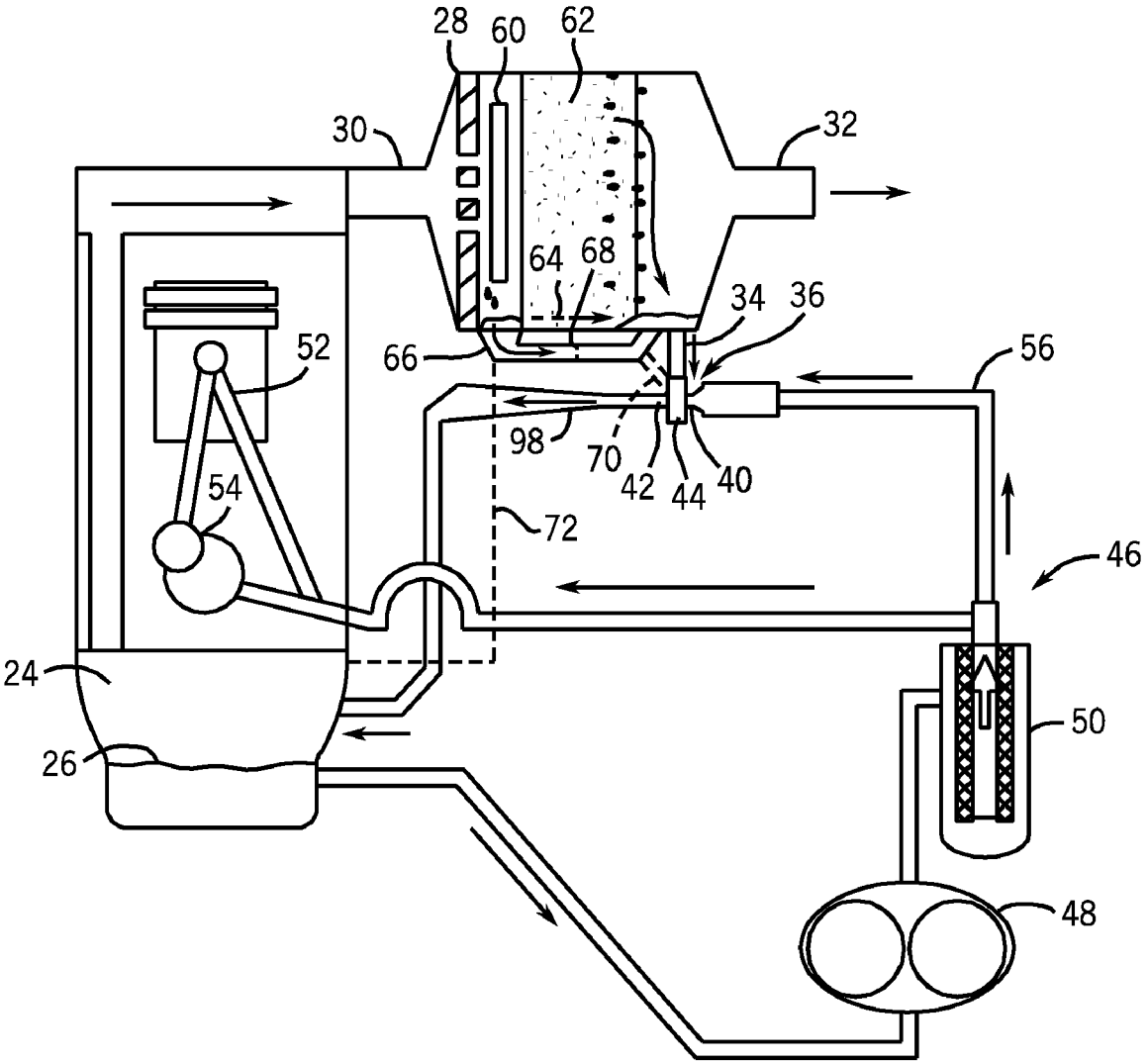
FIG. 4 is like FIG. 1 and shows another embodiment.

FIGS. 3 and 4 show further embodiments and use like reference numerals from above where appropriate to facilitate understanding. In FIG. 1, separator 28 includes an inertial impactor 60, as noted above. In FIG. 3, separator 28 includes a coalescer 62, for example as shown in the above noted incorporated patents. In FIG. 4, separator 28 includes both inertial impactor 60 and coalescer 62, for example as shown in the above noted incorporated patents. In FIG. 4, inertial impactor 60 is upstream of coalescer 62. Separated oil from coalescer 62 drains to oil outlet 34 of the separator. In one embodiment, separated oil from impactor 60 drains through coalescer 62 as shown in dashed line at 64 and then to oil outlet 34 of the separator. In another embodiment, separator 28 has an auxiliary drain channel 66 draining separated oil from impactor 60 to oil outlet 34 of the separator and bypassing coalescer 62. Auxiliary drain channel 66 has a flow-limiting bleed orifice 68 therein. In another embodiment, separator 28 has a second oil outlet at 66 draining separated oil from impactor 60 to suction input 44 of the jet pump as shown in dashed line at 70. In another embodiment, separator 28 has a second oil outlet at 66 draining separated oil from impactor 60 back to crankcase 24 as shown in dashed line at 72, which may require a gravity head, as above noted, which separated oil from impactor 60 drains through second outlet 66 and passage 72 to crankcase 24 by gravity, without passage through jet pump 36 pumping separated oil from first oil outlet 34 of separator 28.

Figure 5:
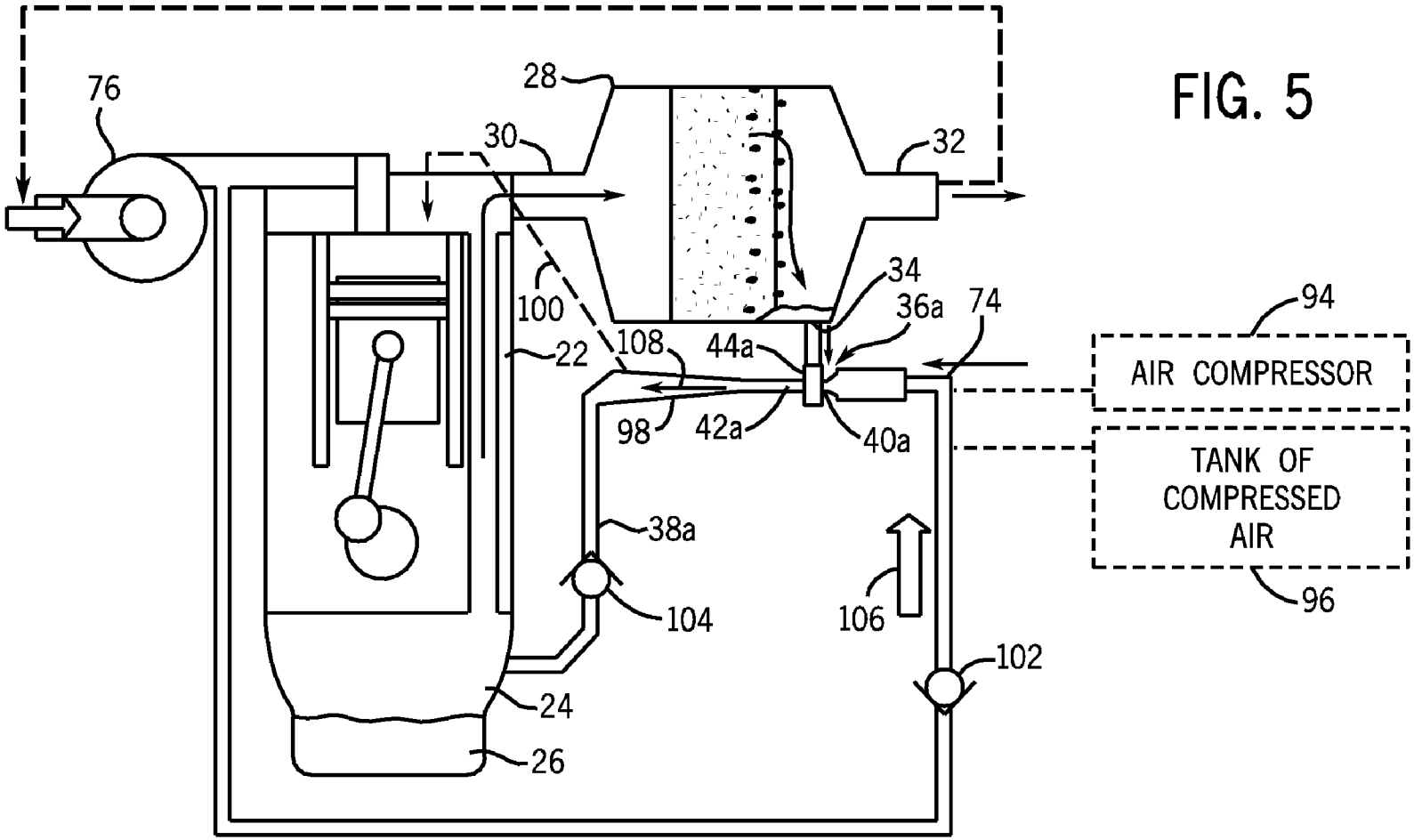
FIG. 5 is like FIG. 1 and shows another embodiment.

FIG. 5 shows a further embodiment and uses like reference numerals from above where appropriate to facilitate understanding. Jet pump 36*a* is an air-driven jet pump having a pressurized drive input 40*a* receiving pressurized motive air at conduit 74 from a compressed air source, to be described, a suction input at 44*a* receiving separated oil from oil outlet 34 of separator 28, and an output 42*a* delivering jet-pumped oil and motive air via conduit 38*a* to crankcase 24. In the embodiment of FIG. 5, engine 22 has a turbocharger 76 delivering pressurized air for combustion. The noted compressed air source is provided by turbocharger 76, and pressurized drive input 40*a* of jet pump 36*a* receives pressurized motive air from turbocharger 76 via air line 74.

Figure 6:
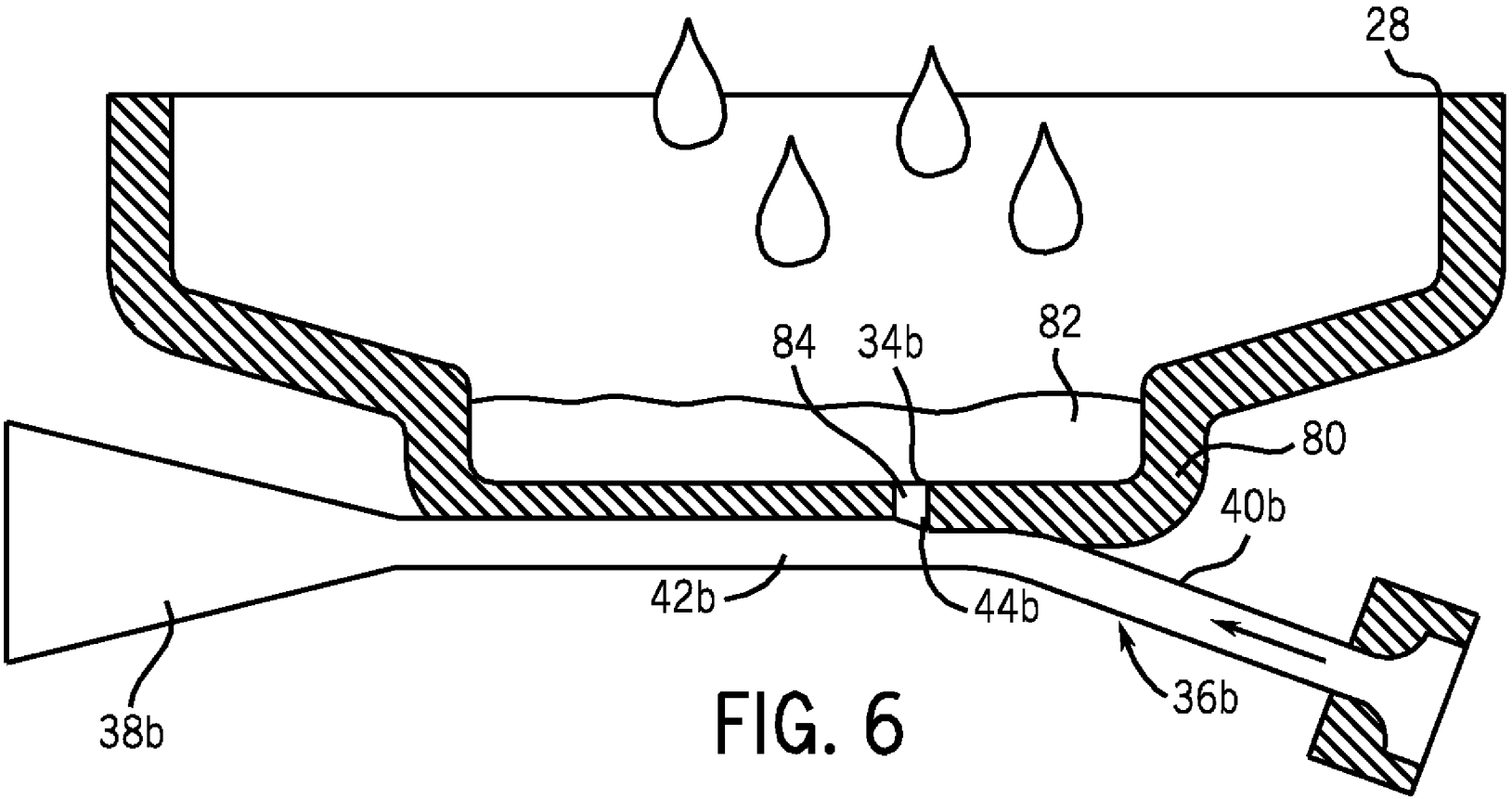
FIG. 6 is an enlarged partial sectional view of a portion of FIG. 1 and showing a further embodiment.

FIG. 6 shows another embodiment and uses like reference numerals from above where appropriate to facilitate understanding. Separator 28 has a lower wall surface 80 providing a collection sump 82 collecting separated oil. Jet pump 36*b* is formed in wall surface 80 and includes a pressurized drive input 40*b* receiving pressurized motive fluid from a source of pressurized fluid, e.g. oil pump 48 or turbocharger 76, a suction input 44*b* receiving separated oil from oil outlet 34*b* provided by a drain passage 84 through wall 80, and an output 42*b* like mixing bore 42*a* and 42 and of greater diameter than drive input 40*b* and delivering jet-pumped oil to the crankcase via conduit 38*b* as above. In various embodiments, the pressurized motive fluid is selected from the group consisting of oil and air, and the source of pressurized fluid is selected from the group consisting of an oil pump, a turbocharger, an air compressor, and a tank of compressed air.

Figure 7:
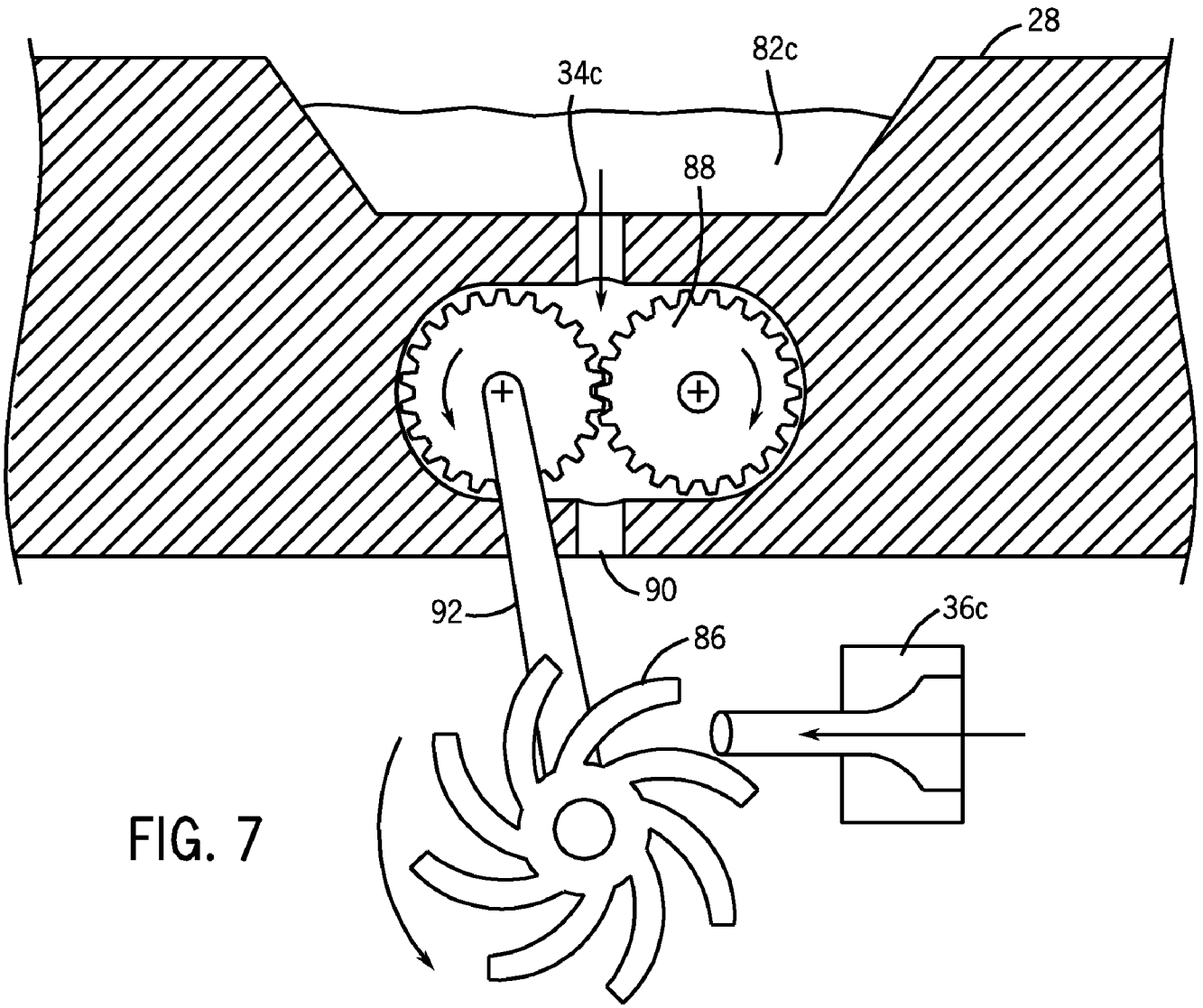
FIG. 7 is an enlarged partial sectional view of a portion of FIG. 1 and showing a further embodiment.

FIG. 7 shows another embodiment and uses like reference numerals from above where appropriate to facilitate understanding. Separator 28 has a lower collection sump at 82*c*. The system includes a turbine 86 driven by jet 36*c*, and a mechanical pump 88 driven by turbine 86 and suctioning oil from oil outlet 34*c* of separator 28 and pumping same at pump outlet 90 to crankcase 24, as above. In one embodiment, with engine 22 having a valvehead closed by a valvehead cover, the turbine is located in such valvehead beneath the valvehead cover. In another embodiment, the turbine is located in the crankcase. Various turbines may be used, including spiral vane turbines, Pelton turbines, Turgo turbines, etc. Various pumps may be used, including simple mechanical pumps, positive displacement gear pumps, etc. Various connections may be used between the turbine and the pump, such as a speed reduction transmission, a rotating shaft, etc.

As above noted, various pressurized motive fluids may be used for the jet pump, including oil, FIGS. 1, 3, 4, and air, FIG. 5. The source of pressurized fluid can be an oil pump, e.g. 48, FIGS. 1, 3, 4, a turbocharger 76, FIG. 5, an air compressor, e.g. as shown in dashed line at 94 in FIG. 5, a tank of compressed air, e.g. as shown in dashed line at 96 in FIG. 5, and other sources. Other variations include multiple jet nozzles 40 feeding a single mixing bore 42. Designs with non-circular motive jet and mixing bore geometries may be used, but are not considered optimal. The use of a diverging diffuser 98, FIG. 1, on the mixing bore exit is desirable but not necessary if maximum pumping efficiency is not needed. In one particular embodiment, jet nozzle 40 has a diameter of 0.3 mm (millimeters), mixing bore 42 has a diameter of 1 mm, the length of mixing bore 42 before it starts to diverge at 98 is 4 mm, and the diameter of suction port 44 is 1 mm, with 40 psi (pounds per square inch) motive pressure oil at 180° F. (Fahrenheit) and a suction liquid source at 34 at 100° F. and a pressure of about minus 15 inches of water (−0.5 psi) relative to the crankcase pressure at 24, with motive flow at about 0.8 mL/s (milliliters per second) and entrained suction flow at about 0.3 mL/s. The predicted "stall suction" (the pressure in suction port 44 at which the jet pump can no longer pull fluid from such suction port) is about 112 inches of water which is well beyond the typical 5 to 15 inches of water needed for such application.

Impactor and coalescer separators have been shown, and other types of aerosol separation devices may be used, including electrostatic separators, cyclones, axial flow vortex tubes, powered centrifugal separators, motor or turbine-driven cone-stack centrifuges, spiral vane centrifuges, rotating coalescers, and other types of separators known for usage in engine blowby aerosol separation.

The scavenged separated oil may be returned directly back to the crankcase at conduit 38, or may be indirectly returned to the crankcase, for example the scavenged separated oil may be returned initially to the valve cover area, as shown in dashed line at 100, FIG. 5, which oil then flows back to the crankcase. Claim limitations regarding a jet pump pumping scavenged separated oil from the oil outlet of the separator to the crankcase may thus include flow path segments through other portions of the engine prior to reaching the crankcase. Furthermore, the term crankcase includes not only the lower region of the engine collecting oil at 26 but also other sections of the engine in communication therewith, including sections at the noted pressure causing the noted backflow tendency, which backflow tendency pressure is overcome by the jet pump.

The motive flow at elevated pressure provided by the jet pump creates a high velocity small diameter jet 40 within a larger diameter mixing bore 42, effectively converting the jet kinetic energy into pumping power, as is known. The motive source 40 and/or the suction source 44 may need screen filter protection to prevent plugging of the very small diameters, e.g. less than 1 mm. For example, it may be desirable to use a filter patch, sintered metal slug, screen, or other filtering to allow liquid and air to flow freely through the device.

In a desirable aspect, many of the illustrated passages may be integrated and contained within engine castings and components, rather than being external lines, which is desirable for reduction of plumbing. The embodiment of FIG. 6 may be desirable to provide a jet impinging on an orifice/groove integrally formed in the sump housing wall to create the desired extraction suction. When using compressed air for the motive fluid, another source may be the engine's air intake manifold, whereby compressed air may be routed from the intake manifold and ducted into the crankcase ventilation system to provide the motive fluid for the jet pump. Molded-in channels may be used to route air from the manifold through the valve cover and into the crankcase ventilation system. Likewise, the scavenged separated oil may be ducted from the jet pump output 42 to the underside of the valve cover, e.g. as shown at 100, for return to the crankcase.

In the preferred embodiment, a jet pump is provided with a mixing bore 42 having a larger diameter than jet 40 in the case of round bores, and a greater cross-sectional area in the case of round or non-round bores or multiple jets 40. In other embodiments, the cross-sectional area of mixing bore 42 may be the same as the cross-sectional area of jet 40, thus providing a jet pump which is a venturi with a smooth transition between jet 40 and mixing bore 42 and no step in diameter therebetween. This type of jet pump venturi relies on Bernoulli's principle to create suction at suction port 44. A jet pump with a larger area mixing bore 42 than jet 40 is preferred because it has higher pumping efficiency and capacity, i.e. it can pull or suction more scavenged oil at port 44 for a given motive flow at jet 40; however, less than optimum pumping efficiency and capacity may be acceptable because only a very small amount of oil need be scavenged and suctioned at port 44 from separator 28. In some instances, a mixing bore 42 having a cross-sectional area slightly less than jet 40 may even be acceptable because of the noted low efficiency and low capacity requirements. Accordingly, the system may use a jet pump having a mixing bore 42 having a cross-sectional area greater than or substantially equal to the cross-sectional area of jet 40. The noted embodiments having the cross-sectional area of mixing bore 42 equal to or slightly less than (substantially equal to) jet 40 provide a venturi or venturi-like jet pump. The preferred jet pump, however, has a mixing bore 42 with a cross-sectional area greater than jet 40 because of the noted higher efficiency and capacity. An area ratio up to about 25:1 (diameter ratio 5:1) may be used in some embodiments, and in other embodiments an area ratio up to about 100:1 (diameter ratio 10:1) may be used, though other area and diameter ratios are possible. The lower limit of a jet pump (cross-sectional area of mixing bore 42 substantially equal to cross-sectional area of jet 40) may thus be used in the present system, though it is not preferred. Instead, a mixing bore 42 having a greater cross-sectional area than jet 40 is preferred.

In a further embodiment, one or more optional check valves 102 and 104, FIG. 5, are provided in the motive line 74 and/or the drain line 38*a* to prevent backflow in a condition (infrequent) of low or negative air supply pressure, e.g. when a truck is in a long down-hill run, where the turbo is idling. Check valve 102 is a one-way valve providing one-way flow as shown at arrow 106, and blocking reverse flow. Check valve 104 is a one-way valve permitting one-way flow as shown at arrow 108, and blocking reverse flow.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. A crankcase ventilation system for an internal combustion engine generating blowby gas in a crankcase containing engine oil and oil aerosol, said system comprising an air/oil separator having an inlet receiving blowby gas and oil aerosol from said crankcase, and having an air outlet discharging clean blowby gas, and an oil outlet discharging scavenged separated oil, and a jet pump pumping said scavenged separated oil from said oil outlet of said separator to said crankcase, wherein said separator has a pressure drop thereacross such that the pressure at said inlet and in said crankcase is higher than the pressure at said air outlet and at said oil outlet, the pressure differential between said crankcase and said oil outlet normally tending to cause backflow of oil from the higher pressure crankcase to the lower pressure oil outlet, said jet pump supplying pumping pressure greater than said pressure differential to overcome said backflow tendency and instead cause suctioning of scavenged separated oil from said oil outlet and pumping same to said crankcase, said jet pump is an air-driven jet pump having a pressurized drive input receiving pressurized motive air from a compressed air source, a suction input receiving separated oil from said oil outlet of said separator, and an output delivering jet-pumped oil and motive air to said crankcase.

2. The crankcase ventilation system according to claim 1 wherein said engine has a turbocharger delivering pressurized air for combustion, and said compressed air source comprises said turbocharger, and said pressurized drive input receives pressurized motive air from said turbocharger.

3. The crankcase ventilation system according to claim 1 wherein said separator comprises an inertial impactor.

4. The crankcase ventilation system according to claim 1 wherein said separator comprises a coalescer.

5. The crankcase ventilation system according to claim 1 wherein said separator comprises a combined inertial impactor and coalescer.

6. The crankcase ventilation system according to claim 1 wherein said impactor is upstream of said coalescer.

7. The crankcase ventilation system according to claim 6 wherein separated oil from said coalescer drains to said oil outlet of said separator, and wherein separated oil from said impactor through said coalescer and then to said oil outlet of said separator.

8. The crankcase ventilation system according to claim 6 wherein separated oil from said coalescer drains to said oil outlet of said separator, and wherein said separator has an auxiliary drain channel draining separated oil from said impactor to said oil outlet of said separator and bypassing said coalescer.

9. The crankcase ventilation system according to claim 8 wherein said auxiliary drain channel has a flow-limiting bleed orifice therein.

10. The crankcase ventilation system according to claim 6 wherein separated oil from said coalescer drains to said oil outlet of said separator, and wherein said separator has a second oil outlet draining separated oil from said impactor to said suction input of said jet pump.

11. The crankcase ventilation system according to claim 6 wherein said separated oil from said coalescer drains to said oil outlet of said separator, and wherein said separator has a second oil outlet draining separated oil from said impactor to said crankcase.

12. The crankcase ventilation system according to claim 11 wherein said separate oil from said impactor drains through said second oil outlet to said crankcase by gravity, without passage through said jet pump.

13. The crankcase ventilation system according to claim 1 wherein said jet pump has a jet provided by said pressurized drive input, and a mixing bore provided by an output delivering jet-pumped oil to said crankcase, said mixing bore having a cross-sectional area greater than or substantially equal to the cross-sectional area of said jet.

14. The crankcase ventilation system according to claim 13 wherein said cross-sectional area of said mixing bore is greater than the cross-sectional area of said jet by a ratio up to 100:1.

15. The crankcase ventilation system according to claim 13 wherein the cross-sectional area of said mixing bore is substantially equal to the cross-sectional area of said jet to provide venturi effect suction at said suction input.

16. The crankcase ventilation system according to claim 13 wherein said mixing bore is round, and said jet is round.

17. The crankcase ventilation system according to claim 13 comprising a plurality of jets feeding said mixing bore.

18. The crankcase ventilation system according to claim 1 comprising a first conduit supplying said pressurized motive fluid to said drive input of said jet pump, and a second conduit delivering said jet-pumped oil to said crankcase from said output of said jet pump, and comprising at least one check valve in one of said first and second conduits permitting one-way flow therethrough.

19. The crankcase ventilation system according to claim 18 comprising two said check valves, a first check valve in said first conduit, and a second said check valve in said second conduit.

20. A crankcase ventilation system for an internal combustion engine generating blowby gas in a crankcase containing engine oil and oil aerosol, said system comprising an air/oil separator having an inlet receiving blowby gas and oil aerosol from said crankcase, and having an air outlet discharging clean blowby gas, and an oil outlet discharging scavenged separated oil, and a jet pump pumping said scavenged separated oil from said oil outlet of said separator to said crankcase, wherein said separator has a pressure drop thereacross such that the pressure at said inlet and in said crankcase is higher than the pressure at said air outlet and at said oil outlet, the pressure differential between said crankcase and said oil outlet normally tending to cause backflow of oil from the higher pressure crankcase to the lower pressure oil outlet, said jet pump supplying pumping pressure greater than said pressure differential to overcome said backflow tendency and instead cause suctioning of scavenged separated oil from said oil outlet and pumping same to said crankcase, wherein said jet pump is a fluid-driven jet pump having a pressurized drive input receiving pressurized motive fluid from a source of pressurized fluid, a suction input receiving separated oil from said oil outlet of said separator, and an output delivering jet-pumped oil to said crankcase, and comprising a first conduit supplying said pressurized motive fluid to said drive input of said jet pump, and a second conduit delivering said jet-pumped oil to said crankcase from said output of said jet pump, and comprising at least one check valve in one of said first and second conduits permitting one-way flow therethrough, wherein said jet pump is an air-driven jet pump having a pressurized said drive input receiving pressurized motive air from a compressed air source.

21. The crankcase ventilation system according to claim 20 wherein said engine has a turbocharger delivering pressurized air for combustion, and said compressed air source comprises said turbocharger.

* * * * *